US007198166B2

(12) United States Patent
Sholinder

(10) Patent No.: US 7,198,166 B2
(45) Date of Patent: Apr. 3, 2007

(54) MODULAR REFUSE CONTAINER

(76) Inventor: Ralph Sholinder, 56 Franson Road, Christina Lake (CA) V0H 1E2

( * ) Notice: Subject to any disclaimer, the term of this patent is extended or adjusted under 35 U.S.C. 154(b) by 436 days.

(21) Appl. No.: 10/786,044

(22) Filed: Feb. 26, 2004

(65) Prior Publication Data

US 2004/0178196 A1 Sep. 16, 2004

Related U.S. Application Data

(60) Provisional application No. 60/454,323, filed on Mar. 14, 2003.

(51) Int. Cl.
*B65D 6/00* (2006.01)
*B65D 8/14* (2006.01)

(52) U.S. Cl. ..... 220/4.33; 220/4.28; 220/908

(58) Field of Classification Search ..... 220/1.5, 220/4.28, 622, 640, 646, 648, 651, 652, 654, 220/692, 908, 7, 4.33
See application file for complete search history.

(56) References Cited

U.S. PATENT DOCUMENTS 2,540,698 A 2/1951 States
3,782,579 A 1/1974 Zarges
4,020,967 A * 5/1977 Hammond et al. ..... 220/6
4,913,301 A 4/1990 Pickler
6,170,686 B1 * 1/2001 Flores ..... 220/4.33
6,234,315 B1 * 5/2001 Karpisek ..... 206/600

FOREIGN PATENT DOCUMENTS

GB 594221 11/1947

* cited by examiner

*Primary Examiner*—Anthony D. Stashick
*Assistant Examiner*—Harry A. Grosso
(74) *Attorney, Agent, or Firm*—Antony C. Edwards

(57) ABSTRACT

A rigid modular container includes a floor and an opposite lid, and between the floor and lid opposite rigid rectilinearly-shaped first and second panels, and oppositely disposed rigid rectilinearly-shaped third and fourth panels extending from and between the first and second panels. The panels are removably mounted to the floor. The side edges of adjacent panels are removably mounted to each other as by bolting so that the side edges of the third and fourth panels abut the side edges of the first and second panels. Fastener bracing means such as bolt bracing are mounted to the side edges of the panels and are aligned between adjacent the panels so that fastener receiving apertures therethrough provide for rigid bracing of rigid fasteners such as bolts mounted through and between the fastener bracing means on the adjacent panels. Rigid fasteners such as bolts may thus be mounted through the fastener bracing means on the adjacent the panels.

32 Claims, 7 Drawing Sheets

MODULAR REFUSE CONTAINER

CROSS REFERENCE TO RELATED APPLICATION

This application claims priority from U.S. Provisional Patent Application No. 60/454,323 filed Mar. 14, 2003 and Canadian Patent Application No. 2,432,197 filed Jun. 13, 2003 entitled Modular Refuse Container.

FIELD OF THE INVENTION

This invention relates to the field of refuse containers referred to as dumpsters, and in particular to an improved refuse container of modular design.

BACKGROUND OF THE INVENTION

Conventional so-called dumpsters, that is, metal refuse containers for storing garbage prior to pick up by a garbage truck, are well known. Such containers are conventionally welded together so as to seal their contents and lend rigidity to the container because the container has to withstand very rough treatment. Damage to dumpsters is very common. For example, in conventional dumpsters the corners often rust out, resulting in the welded dumpsters being discarded entirely, or often dumpsters are marred by graffiti and have to be refurbished. One of the drawbacks with welded fabrication is that the cost to ship the finished containers quite often is of the same order of magnitude as the cost to manufacture them.

In the prior art applicant is aware of U.S. Pat. No. 4,913,301 which issued to Pickier on Apr. 3, 1990 for a Refuse Container, U.S. Pat. No. 3,782,579, U.S. Pat. No. 2,540,698 which issued to States on Feb. 6, 1951 for a Combination Receptacle and Bin and Great Britain Patent No. 594,221 to Harvey accepted Nov. 5, 1947 for Improvements in Bunkers, Bins and like Receptacles. What is neither taught nor suggested, and which it is an object of the present invention to provide, is the improved rigidity in a modular dumpster as exemplified by the embodiment set out below.

SUMMARY OF THE INVENTION

The present invention is a modular dumpster which may be bolted together within a relatively short period of time by the end user with the resultant dumpster sufficiently rigid so as to provide a replacement for conventional dumpsters of welded fabrication. The rigidity is enhanced by the cross-bolting, that is the orthogonal bolting alignment in a horizontal plane, of a pair of cross bolts in each of the four upper corners of the container. At least one of each pair of cross bolts in each corner passes through a rigid bolt brace, which in one embodiment includes a parallel array of four rigid plates formed by the mounting and bracing of rigid channels or tubes along the upper edges of the front, rear and side panels of the container. In this fashion a corresponding bolt hole must pass through the four rigid plates, at least three of which are spaced apart to provide structural stability and rigidity to each modularly constructed upper corner of the container. The lower corners of the container and seams between the panels are modularly fastened by bolting of adjacent panels to each other and to the floor around the lower circumference of the container.

The modular dumpster according to the present invention allows for the shipping of dismantled dumpsters so that many more dumpsters may be shipped for the same freight cost as compared to the shipping of the finished welded dumpsters. Thus for a given flat rate for shipping by truck, where, in the past, a typical truck load was approximately 20 welded containers per truck (more if they are four yard containers and less if they are six yard containers), in shipping dismantled dumpsters the truck can be loaded up to its weight limit. Thus, for example, if a dismantled dumpster weighs approximately 750 lbs., and the weight limit of the truck is 94,000 lbs., then approximately 125 containers may be shipped per truck load.

A further advantage of the modularity of the dumpster of the present invention is that the panels and lids are interchangeable so that, whereas in the past if a side panel or lid of a welded dumpster became damaged, the entire dumpster had to be destroyed or returned to the fabricators, if a panel or floor of the dumpster of the present invention becomes damaged, that component may be simply replaced by the end user. In the modular design of the dumpster of the present invention, the front and back walls may be sized for a common fit as between all of the various models, that is, two yard (standard), three yard, four yard, six yard, and eight yard containers, whether they have square tops or so-called cathedral tops, wherein three yard front and back panels, four yard square front and back panels, four yard slope front, cathedral six yard front and back panels, are interchangeable, and wherein four yard slope back, six yard square front and back panels, eight yard square and cathedral front and back panels are interchangeable.

In summary then, the rigid modular container, whether assembled or in a disassembled kit form for later assembly, according to the present invention may be characterized as including a floor and an opposite lid, and between the floor and lid opposite rigid rectilinearly-shaped first and second panels, and oppositely disposed rigid rectilinearly-shaped third and fourth panels extending from and between the first and second panels. The panels are removably mounted to the floor. The side edges of adjacent panels are removably mounted to each other as by bolting so that the side edges of the third and fourth panels abut the side edges of the first and second panels. Fastener bracing means such as bolt bracing are mounted to the side edges of the panels and are aligned between adjacent the panels so that fastener receiving apertures therethrough provide for rigid bracing of rigid fasteners such as bolts mounted through and between the fastener bracing means on the adjacent panels. Rigid fasteners such as bolts may thus be mounted through the fastener bracing means on the adjacent the panels. The fastener bracing means on the first and second panels may be mounted on outside surfaces of the first and second panels. The fastener bracing means on the third and fourth panels may be mounted on the inside surfaces of the third and fourth panels. The panels may form a cuboid, that is, a generally rectangular parallelepiped.

The fastener bracing means may include a first panel hollow reinforcing member and a second panel hollow reinforcing member mounted across, and on an outer surface of, the first and second panels respectively so as to extend from the opposite side edges of each of the first and second panels. Each end of each reinforcing member may have, mounted in parallel across each end, a first reinforcing insert and a rigid end enclosure so that the each end is a reinforced end. On the third and fourth panels, the fastener bracing means may include third and fourth panel hollow reinforcing members mounted across the third and fourth panels respectively. Each of the third and fourth panel hollow reinforcing members are mounted on an inner surface of the third and fourth panels respectively. Each of the third and fourth panels may have rigid flanges formed along opposite side edges thereof. The rigid flanges extend orthogonally relative to the third and fourth panels and inwardly into the container. Ends of the third and fourth panel hollow reinforcing members may be adjacent for example so as to abut corresponding rigid flanges. Second reinforcing inserts may be mounted in each end of the third and fourth panel hollow reinforcing members, the reinforcing members aligned so as to horizontally align the fastener receiving apertures formed through each of the first and second panel hollow reinforcing members, the first and second panels, the rigid flanges and each of the second reinforcing insert.

In one embodiment the reinforcing members are mounted along an upper end or uppermost edge of the panels. In particular, they may be mounted continuously along the uppermost edges of the panels so as to contiguously strengthen an upper opening of the container defined by the upper edges of the panels. Further, the reinforcing members may be channels rigidly mounted along their edges to the panels.

In one embodiment not intended to be limiting, the first and second panels are, respectively, front and back panels and the third and fourth panels are side panels of the container. The side panels may further include a bolt-on parallel pair of fork-receiving rigid pockets mounted horizontally to the side panels for receiving therein the forks of a front-load truck.

The first and second panels may each further include a lip extending along each side edge of the first and second panels so as to overlap an outer surface of the side edges of the third and fourth panels. Each lip may have at least one fastener aperture therein, and the third and fourth panels would then also have corresponding fastener apertures therein aligning with the fastener apertures in each lip. Second fasteners, which again may be bolts, may be mounted therethrough. Thus in one embodiment the fastener apertures are bolt holes sized to snugly receive bolts journalled therethrough either into threaded engagement therein or so as to protrude for threaded engagement with corresponding threaded nuts.

The floor may be planar and may have at least one stiffening rib mounted or formed there-across. The floor may have a circumferentially extending upstanding rim around its outer circumference for overlapped mating with lowermost edges of the panels. An aperture may be formed in an upstanding rim adjacent the floor, for cooperative alignment with a corresponding apertured formed in a side panel for moisture drainage. These apertures may be securely closed by means of a plug. The rim may be fastened by fasteners such as bolts to the lowermost edges of the panels. Advantageously, the first and second panels may be of a constant and equal first size, and the third and fourth panels may be of an equal second size. The size of the third and fourth panels may be varied to vary the volume of the container.

By means of sloping side wall extensions, the dumpster may be easily converted for use as a recycling container for cardboard and the like in a manner which restricts insertion of unwanted refuse.

For use as a recycling bin, the container may include a pair of rigid wedge-shaped extensions mounted onto upper edges of one pair of the oppositely mounted panels, and a lid mounted on hinge means to an upper edge of the other pair of the oppositely mountable panels so that, when the lid is pivoted the hinge means to a closed position over the container, a front edge of the lid defines an open horizontal slot. Releasable locking means may be provided for lockably closing the lid down onto the extensions.

DETAILED DESCRIPTION OF EMBODIMENTS OF THE INVENTION

Figure 1:
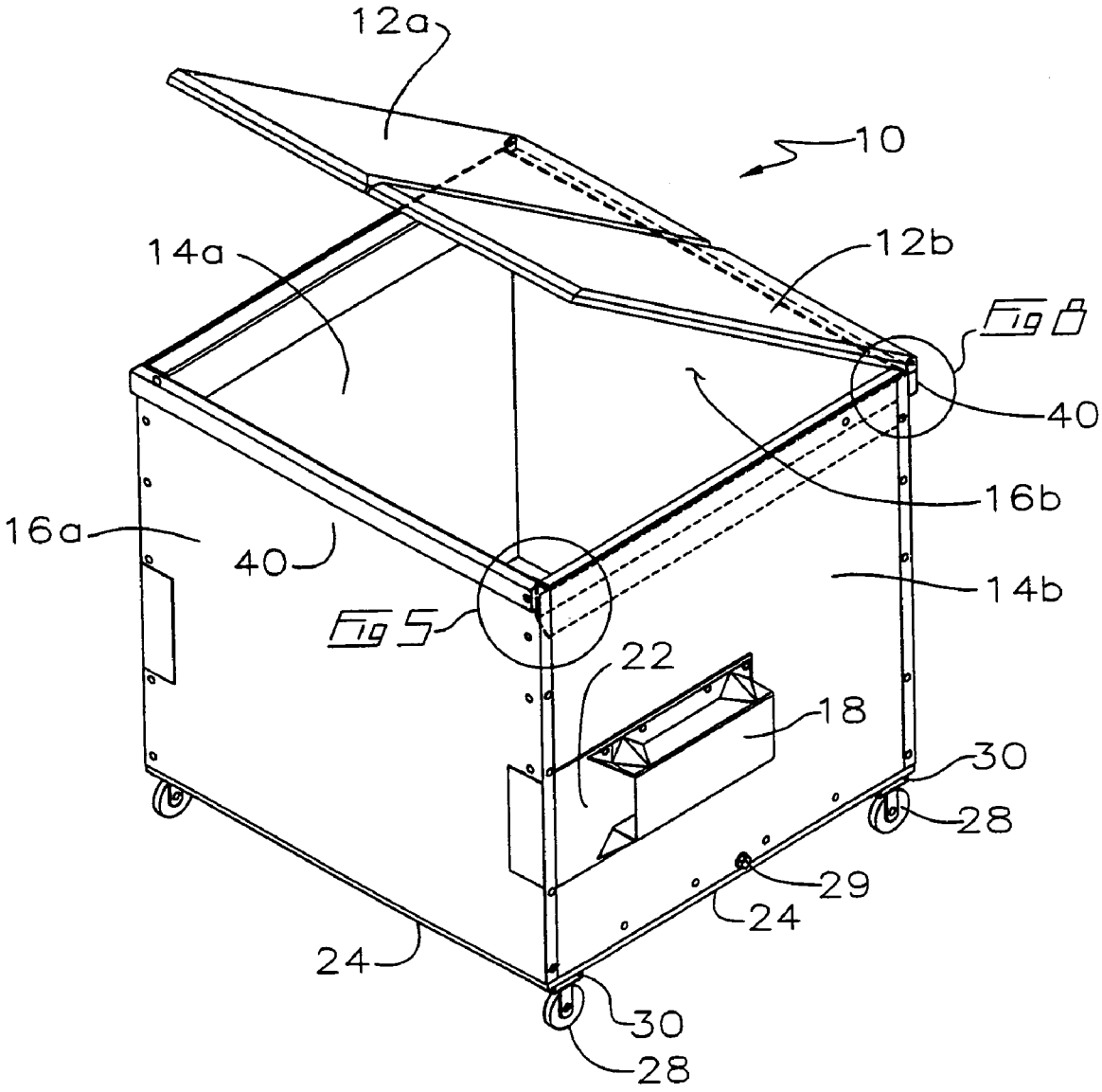
FIG. 1 is, in perspective view, one embodiment of a modular waste container assembled and braced according to the present invention.
Figure 2:
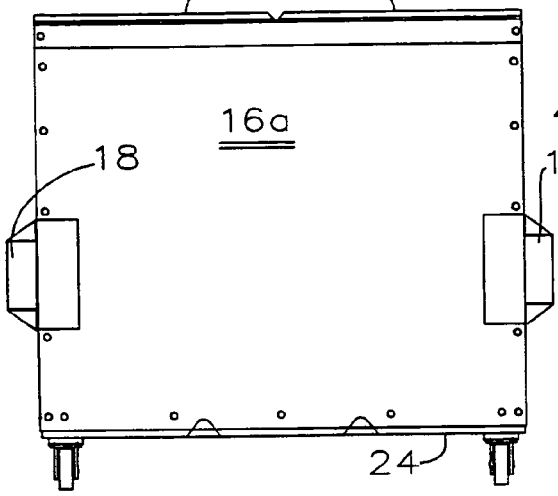
FIG. 2 is, in front elevation view, the waste container of FIG. 1.
Figure 3:
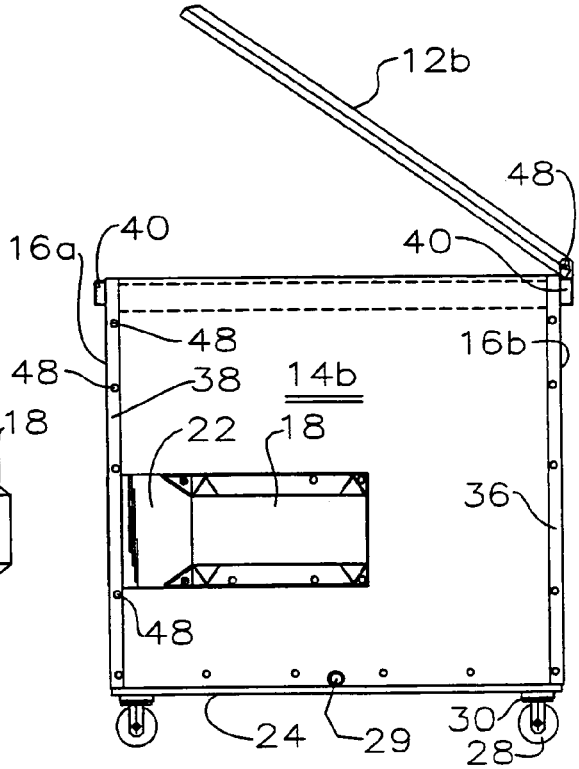
FIG. 3 is, in right side elevation view, the waste container of FIG. 1.

With reference to the drawings wherein similar characters of reference denote corresponding parts in each view, the modular dumpster according to the present invention is illustrated by way of example in FIG. 1, with corresponding views in FIGS. 2–11. As better explained below, the illustrations are representative of the invention without intending to be limiting as to the type of dumpster to which the invention would apply. Thus in FIG. 1 dumpster 10 is illustrated as having flat hinged lids 12*a* and 12*b*, it being understood that other types of dumpsters, for example, so-called cathedral top dumpsters, or dumpsters having inclined covers, whether they be of metal, plastic or other material, and whether they be three yard, four yard, six yard or other sizes are intended to also fall within the scope of the present invention. By way of further example then, side panels 14*a* and 14*b* are modularly bolted to front and rear panels 16*a* and 16*b* respectively so that, depending on the size of the side panels or on the size of the front and rear panels, the volume of the dumpster may be modified. In one preferred embodiment, the size of front and rear panels 16*a* and 16*b* remains constant and the width of side panels 14*a* and 14*b* may be selected so as to provide for example a three yard dumpster, or a four yard dumpster, or a six yard dumpster.

Figure 11:
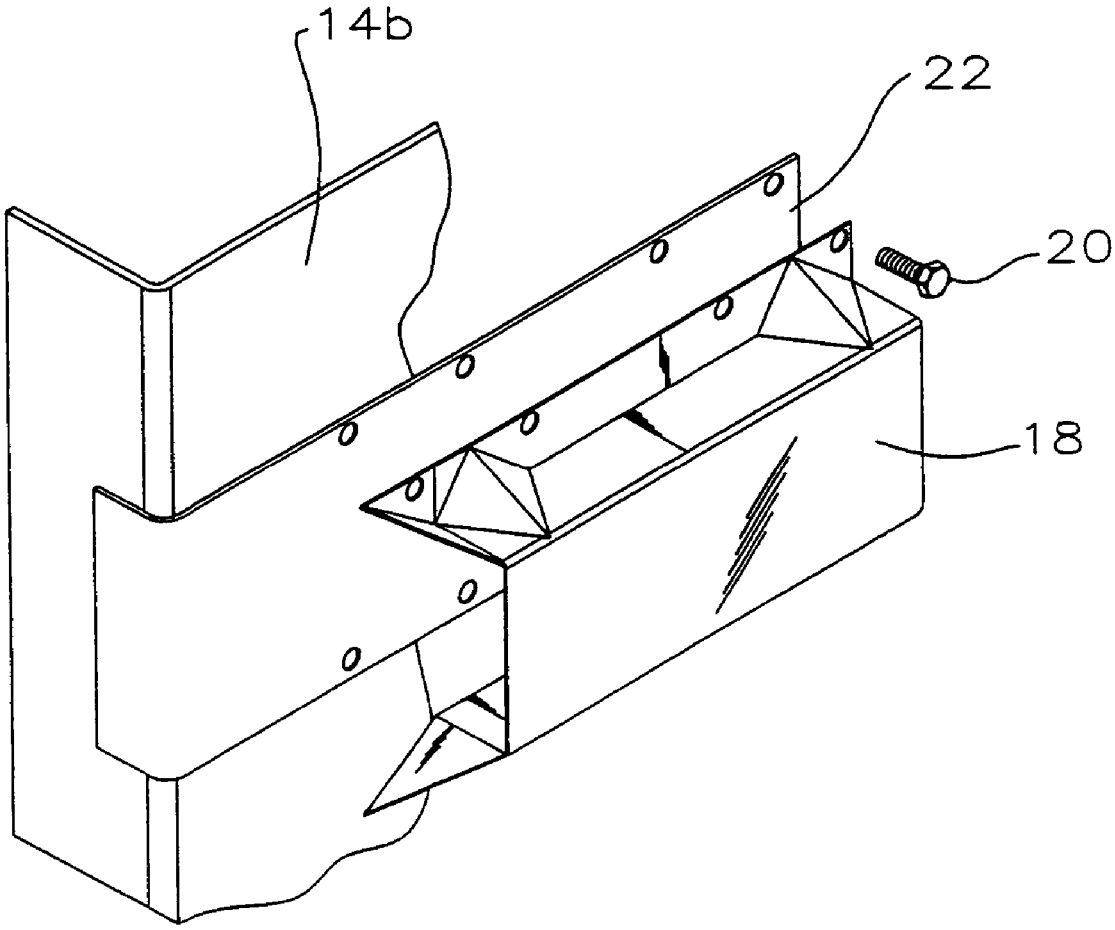
FIG. 11 is, in enlarged partially exploded and cut away perspective view, the right fork receiver of the waste container of FIG. 1.

A pair of channel members 18 are rigidly bolted to side panels 14*a* and 14*b* so as to accept, in releasably slidably journalled engagement therein, the forks of a conventional truck-mounted dumpster unloader. In the present invention, advantageously channel members 18 are mounted, by bolts 20, (only one of which is illustrated in FIG. 11 for clarity of the illustration) through corresponding holes in the corresponding side panel and through base plate 22. Bolts 20 threadably engage corresponding nuts (not shown) on the inside of the corresponding base plate 22.

Figure 4:
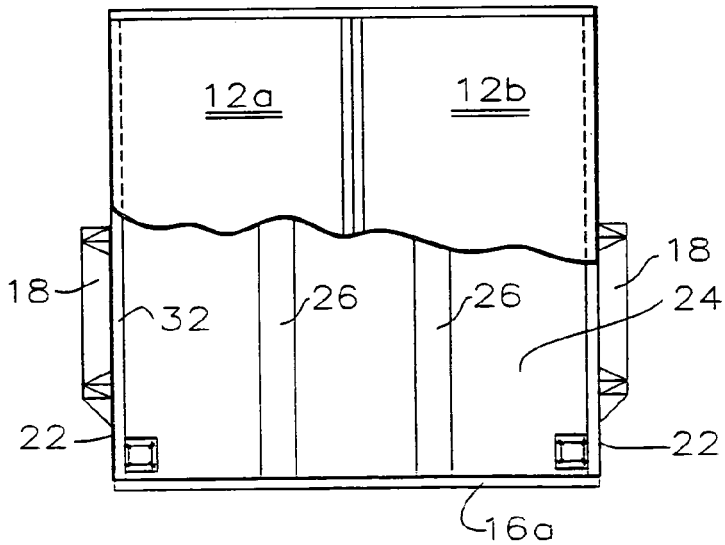
FIG. 4 is, in partially cut away plan view, the waste container of FIG. 1.
Figure 5:
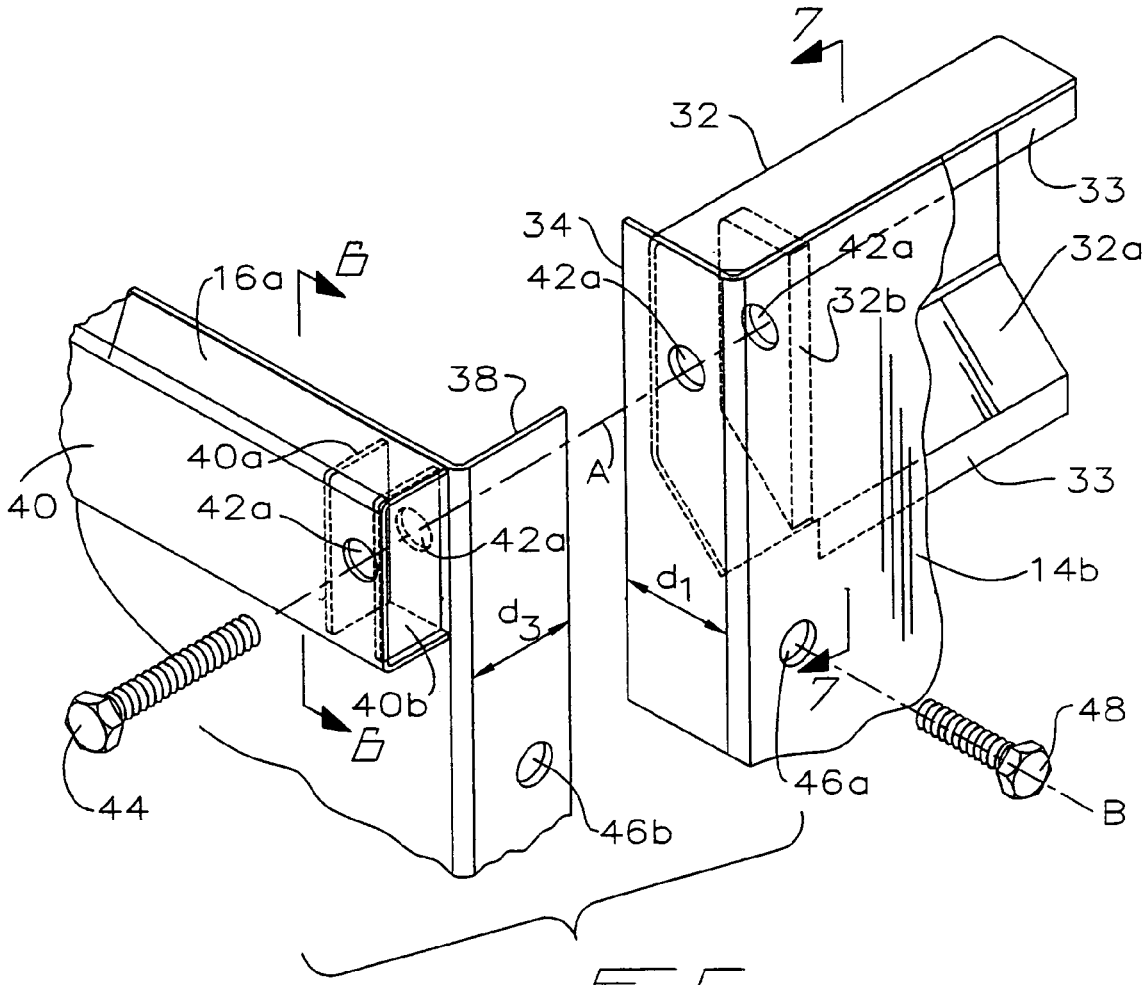
FIG. 5 is, in an enlarged and partially exploded and cut away view, the upper front right corner of the waste container of FIG. 1.
Figure 6:
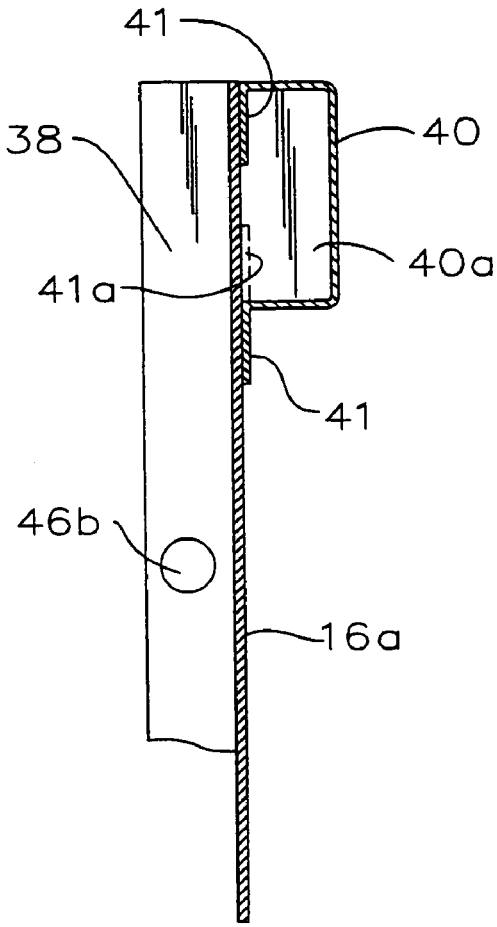
FIG. 6 is a cross sectional partially cut away view along line 6—6 in FIG. 5.
Figure 7:
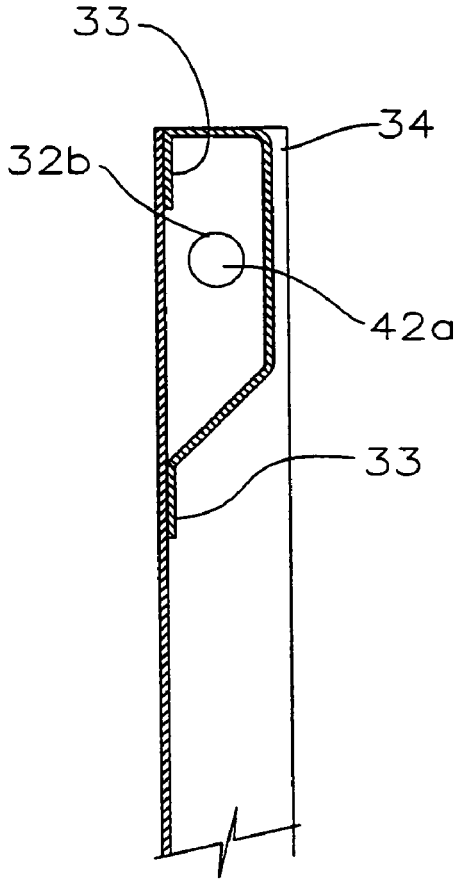
FIG. 7 is a cross sectional partially cut away view along line 7—7 in FIG. 5.
Figure 7A:
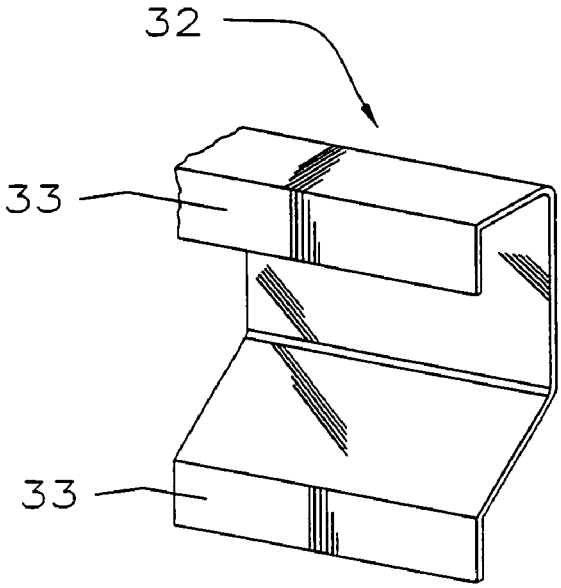
FIG. 7*a* is a perspective view of one form of upper reinforcing bar.
Figure 8:
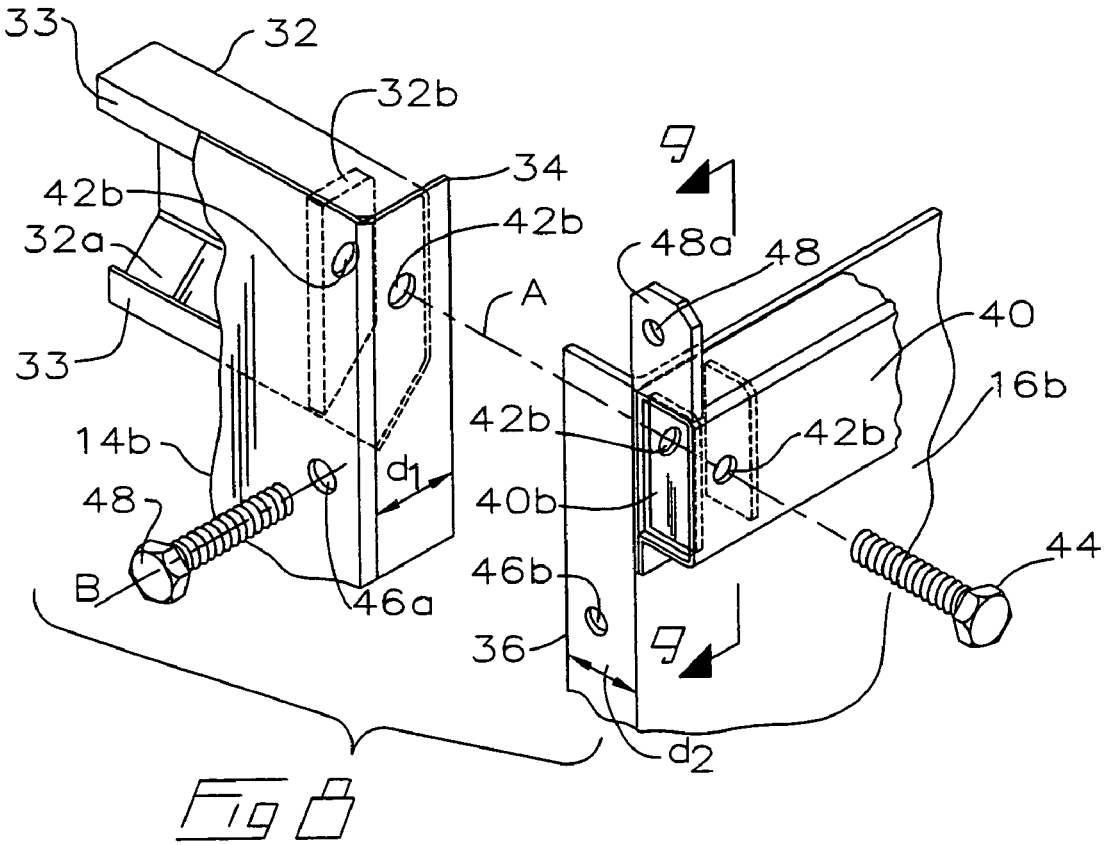
FIG. 8 is, in enlarged partially exploded and cut away view, the upper rear right corner of the waste container of FIG. 1.
Figure 9:
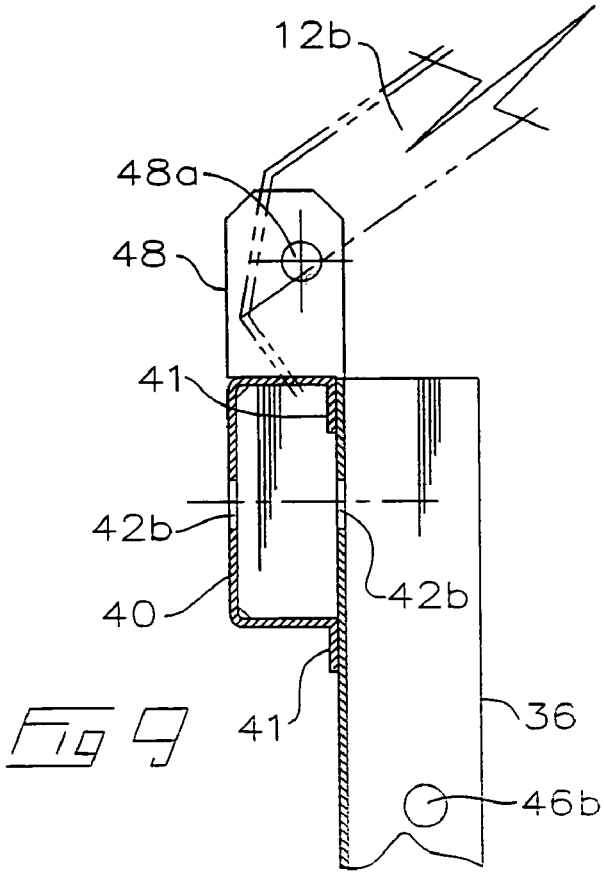
FIG. 9 is a cross sectional view along line 9—9 in FIG. 8.
Figure 10:
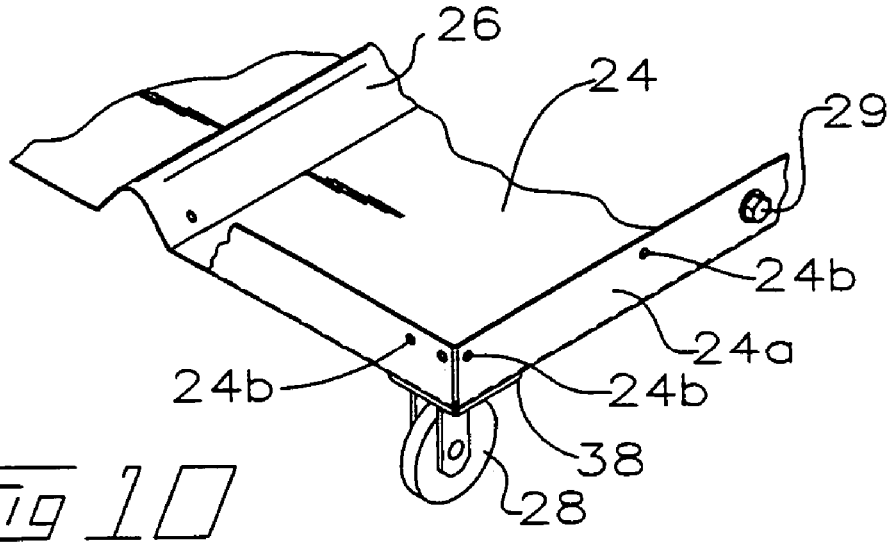
FIG. 10 is, in a perspective partially cut away view, the lower right front corner of the floor panel of the waste container of FIG. 1.

As better seen in FIGS. 4 and 10, the rigid floor panel 24 of the dumpster is reinforced by stringers 26 which may be formed out of the floor panel or may be separate pieces rigidly mounted thereon so as to extend from the front panel to the rear panel. Optional wheels 28, which may be casters, are rotatably mounted on mounting brackets 30 which themselves are bolted to the underside of floor panel 24 in all four corners of the floor panel. The circumferential edges of the floor panel 24 are formed as upturned rim flanges 24*a* having a spaced apart array of bolt holes 24*b* formed therealong. Corresponding bolt holes are formed along the lower circumferential edges of the front, rear and side panels so that the front, rear and side panels may be bolted onto rim flanges 24*a*. A moisture drainage aperture 29 and suitable plug is positioned adjacent floor panel 24 in one of the side panels, for example panel 14*b*. A cooperatively aligned aperture is also formed in the circumferential edge of the floor panel.

Each side panel has a reinforcing bar 32 rigidly mounted along upper edge of the side panel, on the inside surface of the side panel. Each side panel has an inwardly turned rigid flange 34 formed along the length of its opposite front and rear edges. Reinforcing bar 32 extends between the front and rear rigid flanges 34 and is rigidly mounted thereto. Reinforcing bar 32 has a sloped lower edge 32*a* which slopes downwardly towards the floor panel. Sloped edge 32*a* is inclined downwardly towards the floor panel of the dumpster so that when the dumpster is inverted to unload its contents, the contents will not hang up or catch against the reinforcing bar. In a preferred form reinforcing bar 32 may be secured to sidewalls 14 by either spot welding or by epoxy. To facilitate such connection, tabs 33 are integrally formed at the upper and lower edges of bar 32 and provide a contact surface for positioning against the interior surface of side walls 14*a* and 14*b*. Similarly, front and rear reinforcing tubes 40 may be provided with similar connection tabs 41. As may be viewed in FIG. 6, lower connection tab 41*a* may optionally extend internally or externally of tube 40.

Each rigid flange 34 on each side panel has a depth dimension $d_1$. Rigid flanges 34 snugly mate so as to be nested against inwardly turned rigid flanges 36 and 38 on rear panel 16*b* and front panel 16*a* respectively. Flanges 36 are formed on both side edges of the rear panel. Flanges 38 are formed on both side edges of the front panel. Each rigid flange 36 has a corresponding depth dimension $d_2$. Rigid flanges 38 have corresponding depth dimensions $d_3$.

Horizontal reinforcing tubes 40 are mounted along the upper edges of front and rear panels 16*a* and 16*b* so as to extend from each side edge of each front and rear panel. Each end of reinforcing tubes 40 have, mounted in parallel across each end, reinforcing plates inserts such as 40*a* and end closures such as plates 40*b* forming reinforced ends of tubes 40 through which bolts may be rigidly mounted. Horizontally aligned bolt holes 42*a*, aligned along axis A are formed through, respectively, the outermost surface of reinforcing tubes 40, and through the sheeting of the front and rear panels 16*a* and 16*b*. Corresponding bolt holes continue through rigid flanges 34 and through reinforcing plates 32*b* mounted within reinforcing bars 32. Bolts 44 may then be inserted through bolt holes 42*a* and 42*b* so as to threadably engage, for example, threading within the bolt holes in reinforcing plates 32*b* or through for example threaded nuts (not shown) welded to plates 32*b*. The front panel is thereby bolted onto the side panels with rigid flanges 38 overlapped onto the front edges of the side panels. Overlapping rigid flanges 38 along the front edges of the side panels snugly engages rigid flanges 34 against the inner surfaces of front panel 16*a* so as to snugly nest the vertically extending corners formed between rigid flanges 34 and the front edges of the side panels into the corresponding corners formed between rigid flanges 38 and the front surface of front panel 16*a*. Similarly, flanges 36 on rear panel 16*b* overlap corresponding flanges 34 on the side panels so as to nest flanges 34 into the vertical corners along the vertical edges of rear panel 16*b*, bolts 44 bolting the rear panel onto the side panels through bolt holes 42*b*.

With the corners so snugly nested, dimension $d_1$ of rigid flanges 34 provides sufficient area so that bolt holes 42*a* in rigid flanges 34 may be aligned with bolt holes 42*a* in reinforcing tube 40. Similarly, dimension $d_3$ of rigid flange 38 provides sufficient area so that the vertically spaced apart array of bolt holes 46*a* on the side panels may be aligned with bolt holes 46*b* formed in rigid flanges 36 and 38 for bolting therethrough of bolts 48. In this manner, each of the upper four corners of dumpster 10 are rigidly formed by the rigid interlocking mating and bolting of the front and rear panels and their respective flanges 38 and 36 with the corresponding side panels and their rigid flanges 34, each corner being rigidly fastened by the orthogonally oriented threaded coupling of bolts 44 through bolt holes 42*b* and bolts 48 through bolt holes 46*a* and 46*b* along their respective axes A and B. Bolts 48 are fastened through bolt holes 46*a*, and 46*b* by for example the use of threaded nuts (not shown) on the inside of the container behind flanges 34. The fully assembled dumpster has all apertures sealed to prohibit ingress of crawling insects such as ants.

The reinforcing plates and end plates serve to brace the ends of the hollow reinforcing tubes and bars. Thus when bolts are inserted through the array of bolt holes, that is in all of the reinforced ends, twisting or other relative movement between adjacent panels is resisted because each bolt is held rigidly aligned relative to each panel by the alignment of four bolt holes per bolt, two holes per panel. Of course the same result may be achieved, with a weight gain, by the use of bored solid ends on the reinforcing tubes or bars where the solid ends each have a bolt receiving bore, or by just the use of bored solid ends or brackets without the corresponding reinforcing tubes or bars. Further, the reinforcing tubes or bars may also be channels or the like welded to the panels, it being intended herein that reference to reinforcing tubes or bars is to include within its scope stiffening or other reinforcing members or means, and that reference herein to fastener bracing means or bolt bracing means is to include the use of rigidly aligned fastener or bolt holes or bores in rigid reinforcing members or reinforcing means, or in other rigid braces, brackets, members or the like fastened to panels of the container.

Hinge tabs 48 are rigidly mounted so as to upstand vertically from the opposite ends of reinforcing bar 40 on rear panel 16*b*. Holes 48*a* are formed through hinge tabs 48 for journaling therethrough of a hinge rod or hinge pins mounted to lids 12*a* and 12*b* so that the lids may be pivoted on hinge tabs 48.

Figure 12:
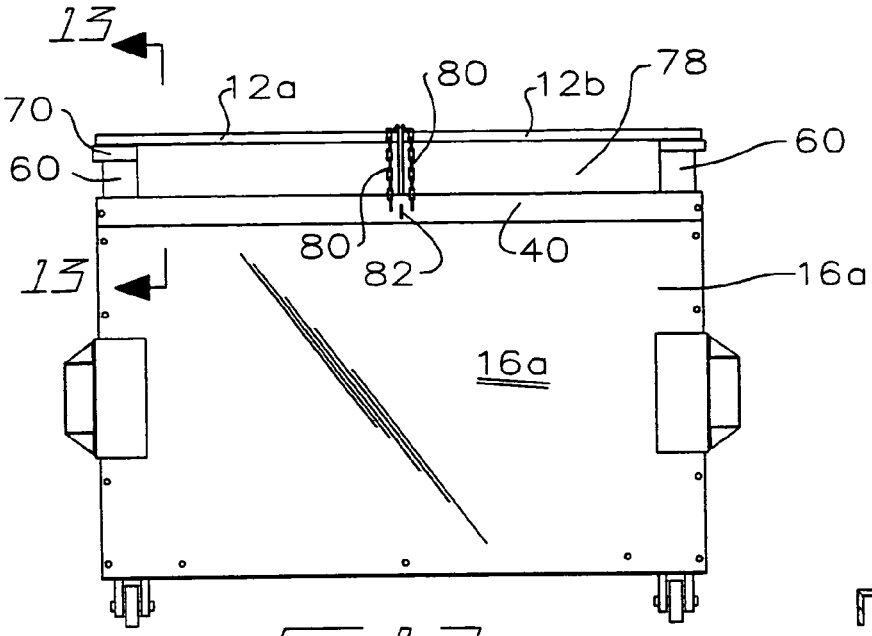
FIG. 12 is in frontal elevation the waste container with lid in the closed position, assembled for receiving recyclable materials.
Figure 14:
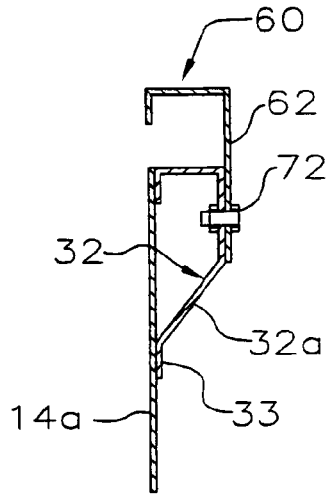
FIG. 14 is a cross sectional view along line 14—14 of FIG. 13.
Figure 13:
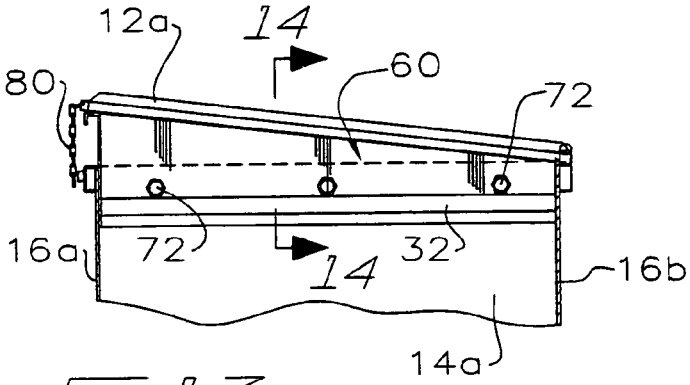
FIG. 13 is a cross sectional view along line 13—13 of FIG. 12.
Figure 15:
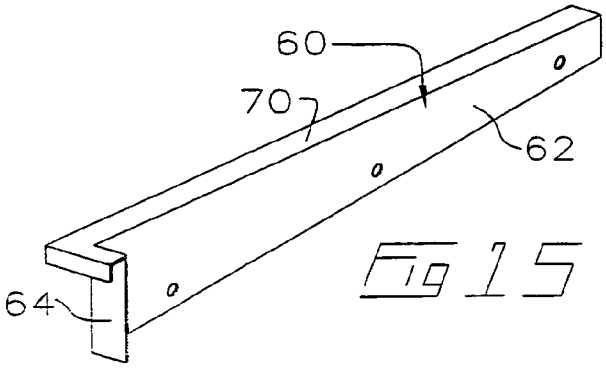
FIG. 15 is, in perspective view, a sloping sidewall extension from FIG. 12.

The refuse receiving dumpster of the present invention may be readily converted to a dumpster for receiving recyclable material such as paper, cardboard or the like in a manner which precludes ready insertion of non-recyclable waste material and refuse. As will be seen in FIGS. 14 and 15, a wedge-shaped side wall extension 60 has an elongated first leg 62 and a short second leg 64 projecting generally at right angles from wide end thereof. First leg and second legs 62 and 64 may be inserted within dumpster 10, with first leg 62 positioned adjacent to the vertical surface of sidewall reinforcing bars 32 and with second leg 64 positioned adjacent to the inside surface of front panel 16*a*. The upper edge 66 of legs 62 and 64 has an outwardly projection flange 70. The upper edge 66 of first leg 62 is downwardly sloped from its confluence with second leg 64 to the distal end of leg 62 to enable corresponding flange 70 to provide a sloped support for the outer edge of lid 12. The generally horizontally disposed flange on second leg 64 supports a portion of the front edge of the lid. Two side wall extensions are required as can be seen in FIG. 12 and can be removably secured in place with bolts 72 or like fasteners which pass through mating apertures in both side wall extensions and reinforcing bar.

With the lid closed on top of the side wall extensions and secured in place by any suitable means against unwarranted elevation recycling material may easily inserted through the front opening 78. A suitable locking device, as illustrated is separate lengths of chain 80 or cable fixed at one end to each of the lids and removably securable at its other end to a projecting lug 82 positioned medially of reinforcing tube 40 on front wall 16*a*.

Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A rigid modular container comprising:

a floor, opposite rigid rectilinearly-shaped first and second panels, and oppositely disposed rigid rectilinearly-shaped third and fourth panels extending from and between said first and second panels, said panels mounted to said floor and having opposite side edges, said side edges of said third and fourth panels abutting said side edges of said first and second panels, fastener bracing means mounted to said side edges of said panels and aligned between adjacent said panels, said fastener bracing means baying fastener receiving apertures therethrough for rigid bracing of rigid fasteners mounted through and between said fastener bracing means on said adjacent panels, rigid elongate fasteners mounted through said fastener bracing means on said adjacent said panels, said fastener bracing means on said first and second panels being mounted on outside surfaces thereof, said fastener bracing means on said third and fourth panels being mounted on inside surfaces thereof, wherein each said fastener bracing means includes at least two aligned spaced apart apertures for snugly journalled mounting therethrough of said elongate fasteners, so that with adjacent said fastener bracing means on said adjacent panels, said at least two aligned spaced apart apertures on said each fastener bracing means forms an aligned array of said at least two aligned spaced apart apertures, wherein one of said elongate fasteners is linearly journalled therethrough so as to rigidly align said adjacent panels and wherein said elongate fasteners also securely releasably mate said adjacent panels together.

2. The rigid modular container of claim 1 wherein said first and second panels, and said third and fourth panels extending between said first and second panels form a generally rectangular parallelepiped, and wherein said fastener bracing means comprises a first panel hollow reinforcing member and a second panel hollow reinforcing member mounted across, and on an outer surface of, said first and second panels respectively so as to extend from said opposite side edges of each said first and second panels, each end of each said reinforcing member having mounted in parallel across said each end, a first reinforcing insert and a rigid end enclosure so that said each end is a reinforced end, and wherein, on said third and fourth panels, said fastener bracing means comprising third and fourth panel hollow reinforcing members mounted across said third and fourth panels respectively, each said third and fourth panel hollow reinforcing members mounted on an inner surface of said third and fourth panels respectively, each of said third and fourth panels having rigid flanges formed along opposite side edges thereof, said rigid flanges extending orthogonally relative to said third and fourth panels inwardly into said container, ends of said third and fourth panel hollow reinforcing members adjacent corresponding said rigid flanges, second reinforcing inserts mounted in each said end of said third and fourth panel hollow reinforcing members, said reinforcing members aligned so as to horizontally align said at least two aligned spaced apart apertures fanned through each said first and second panel hollow reinforcing member, said first and second panels, said rigid flanges and each said second reinforcing inserts.

3. The container of claim 2 wherein said reinforcing members are mounted along an upper end of said panels.

4. The container of claim 3 wherein said reinforcing members are mounted continuously along uppermost edges of said panels so as to contiguously strengthen an upper opening of said container defined by said upper edges of said panels.

5. The container of claim 3 wherein said reinforcing members are channels rigidly mounted along their edges to said panels.

6. The container of claim 5 wherein said first and second panels are, respectively, front and back panels and said third and fourth panels are side panels, said side panels further comprising a parallel pair of fork-receiving rigid pockets mounted horizontally to said side panels for receiving therein the forks of a front-load truck.

7. The container of claim 2 wherein said first and second panels each further include a lip extending along each said side edge of said first and second panels so as to overlap an outer surface of said side edges of said third and fourth panels, and wherein each said lip has at least one aperture of said at least two aligned spaced apart apertures therein and said third and fourth panels have corresponding said at least one apertures therein aligning with said at least one apertures in each said lip, said elongate fasteners mounted therethrough.

8. The container of claim 7 wherein said at least one apertures are bolt holes and wherein said elongate fasteners are bolts, said bolt holes sized to snugly receive said bolts journalled therethrough.

9. The container of claim 1 wherein said floor is planar and has at least one stiffening rib there-across.

10. The container of claim 9 wherein said floor has a circumferentially extending upstanding rim around a circumference of said floor in overlapped mating with lowermost edges of said panels.

11. The container of claim 10 wherein said rim is fastened by fasteners to said lowermost edges.

12. The container of claim 1 wherein said first and second panels ate of a constant and equal first size, and wherein said third and fourth panels are of an equal second size, and wherein said second size of said third and fourth panels is varied to vary the volume of said container.

13. The container of claim 1 further comprising a pair of rigid wedge-shaped extensions mounted onto upper edges of one pair of said oppositely mounted panels, and a lid mounted on hinge means to an upper edge of the other pair of said oppositely mountable panels so that, when said lid is pivoted on said hinge means to a closed position over said container, a front edge of said lid defines an open horizontal slot.

14. The container of claim 13 further comprising releasable locking means for lockably closing said lid down onto said extensions.

15. The container of claim 1 further comprising a pair of rigid wedge-shaped extensions mounted onto upper edges of third and fourth panels, and a lid mounted on hinge means to an upper edge of said first panel so that, when said lid is pivoted on said hinge means to a closed position over said container a front edge of said lid and a corresponding upper edge of said second panel define a forwardly disposed slot.

16. The container of claim 15 further comprising releasable locking means for lockably closing said lid down onto said extensions.

17. A rigid modular container kit comprising:

an oppositely mountable floor and lid, oppositely mountable rigid rectilinearly-shaped first and second panels, arid oppositely mountable rigid rectilinearly-shaped third and fourth panels extending from and between said first and second panels, said panels mountable to said floor, said panels having opposite side edges, said side edges of said third and fourth panels mountable so as to abut said side edges of said first and second panels, fastener bracing means mounted to said side edges of said panels and alignable between adjacent said panels when said panels are mounted to said floor, said fastener bracing means having fastener receiving apertures therethrough for rigid bracing of rigid fasteners mounted trough and between said fastener bracing means on said adjacent panels, rigid elongate fasteners mounted through said fastener bracing means on said adjacent said panels, said fastener bracing means on said first and second panels being mounted on outside surfaces thereof and said fastener bracing means on said third and fourth panels being mounted on inside surfaces thereof when said panels are mounted to each other, wherein each said fastener bracing means includes at least two aligned spaced apart apertures for snugly journalled mounting therethrough of said elongate fasteners, so that with adjacent said fastener bracing means on said adjacent panels, said at least two aligned spaced apart apertures on said each fastener bracing means forms an aligned array of said at least two aligned spaced apart apertures, wherein one of said elongate fasteners is linearly journalled therethrough so as to rigidly align said adjacent panels and wherein said elongate fasteners also securely releasably mate said adjacent panels together.

18. The rigid modular container of claim 17 wherein said panels when mounted to each other form a generally rectangular parallelepiped, and wherein said fastener bracing means comprises a first panel hollow reinforcing member and a second panel hollow reinforcing member mounted across, and on an outer surface of, said first and second panels respectively so as to extend from said opposite side edges of each said first and second panels, each end of each said reinforcing member having, mounted in parallel across said each end, a first reinforcing insert and a rigid end enclosure so that said each end is a reinforced end, and wherein, on said third and fourth panels, said fastener bracing means comprising third and fourth panel hollow reinforcing members mounted across said third and fourth panels respectively, each said third and fourth panel hollow reinforcing members mounted on an inner surface of said third and fourth panels respectively, each of said third and fourth panels having rigid flanges formed along opposite side edges thereof, said rigid flanges extending orthogonally relative to said third and fourth panels inwardly into said container when said panels are mounted to each other, ends of said third and fourth panel hollow reinforcing members adjacent corresponding said rigid flanges, second reinforcing inserts mounted in each said end of said third and fourth panel hollow reinforcing members, said reinforcing members aligned so as to horizontally align said at least two aligned spaced apart apertures formed through each said first and second panel hollow reinforcing member, said first and second panels, said rigid flanges and each said second reinforcing inserts.

19. The container of claim 18 wherein said reinforcing members are mounted along an upper end of said panels.

20. The container of claim 19 wherein said reinforcing members are mounted continuously along uppermost edges of said panels so as to contiguously strengthen an upper opening of said container defined by said upper edges of said panels when said panels are mounted to each other.

21. The container of claim 19 wherein said reinforcing members are channels rigidly mounted along their edges to said panels.

22. The container of claim 21 wherein said first and second panels are, respectively, front and back panels and said third and fourth panels are side panels, said side panels further comprising a parallel pair of fork-receiving rigid pockets mounted horizontally to said side panels for receiving therein the forks of a front-load truck.

23. The container of claim 18 wherein said first and second panels each further include a lip extending along each said side edge of said first and second panels so as to overlap an outer surface of said side edges of said third and fourth panels when said panels are mounted to each other, and wherein each said lip has at least one aperture of said at least two aligned spaced apart apertures therein and said third and fourth panels have corresponding said at least one apertures therein aligning with said at least one apertures in each said lip, said elongate fasteners mountable therethrough.

24. The container of claim 23 wherein said at least one apertures are bolt holes and wherein said elongate fasteners are bolts, said bolt holes sized to snugly receive said bolts journalled therethrough.

25. The container of claim 17 wherein said floor is planar and has at least one stiffening rib there-across.

26. The container of claim 25 wherein said floor has a circumferentially extending upstanding rim round a circumference of said floor for overlapped mating with lowermost edges of said panels.

27. The container of claim 26 wherein said rim is fastened by fasteners to said lowermost edges.

28. The container of claim 17 wherein said first and second panels are of a constant and equal first size, and wherein said third and fourth panels are of an equal second size, and wherein said second size of said third and fourth panels is varied to vary the volume of said container when said panels are mounted to each other.

29. The container kit of claim 17 further comprising a pair of rigid wedge-shaped extensions mountable onto upper edges of one pair of said oppositely mountable panels, and a lid mountable on hinge means to an upper edge of the other pair of said oppositely mountable panels so that, when said lid is pivoted on said hinge means to a closed position over said container, once assembled, a front edge of said lid defines an open horizontal slot.

30. The container of claim 29 further comprising releasable locking means for lockably closing said lid down onto said extensions.

31. The container kit of claim 17 further comprising a pair of rigid wedge-shaped extensions mountable onto upper edges of said third and fourth panels so as to dispose narrow ends of said extensions towards said first panel, and a lid mountable on hinge means to an upper edge of said first panel so that, when said lid is pivoted on said hinge means to a closed position over said container, once assembled, a front edge of said lid and a corresponding upper edge of said second panel define a forwardly disposed horizontal slot.

32. The container of claim 31 further comprising releasable locking means for lockably closing said lid down onto said extensions.

* * * * *